United States Patent [19]

Torok

[11] Patent Number: 5,040,921

[45] Date of Patent: Aug. 20, 1991

[54] SEGMENTED TUNNEL SYSTEM

[76] Inventor: Frank J. Torok, 13515 Broadway, #10 Circle Dr., Alden, N.Y. 14004

[21] Appl. No.: 533,024

[22] Filed: Jun. 4, 1990

Related U.S. Application Data

[63] Continuation-in-part of Ser. No. 406,619, Oct. 13, 1989, abandoned.

[51] Int. Cl.[5] ..... E21D 10/02; E21D 9/00; E21D 9/14

[52] U.S. Cl. ..... 405/150; 405/135; 405/149; 405/152

[58] Field of Search ..... 405/132, 134, 149, 150, 405/151, 152, 135, 153; 52/88

[56] References Cited

U.S. PATENT DOCUMENTS

| | | | |
|---|---|---|---|
| 617,615 | 1/1899 | Thacher | 52/88 |
| 709,794 | 9/1902 | Parmley | 52/88 |
| 2,077,137 | 4/1937 | Wilkoff | 405/151 |
| 4,650,369 | 3/1987 | Thomas et al. | 405/150 X |
| 4,695,187 | 9/1987 | Mikhailovsky et al. | 405/150 X |
| 4,836,714 | 6/1989 | Matiere | 405/134 |
| 4,854,775 | 8/1989 | Lockwood | 405/134 X |

FOREIGN PATENT DOCUMENTS

| | | | |
|---|---|---|---|
| 507168 | 12/1951 | Belgium | 405/132 |
| 511970 | 12/1952 | Belgium | 405/150 |
| 566996 | 5/1958 | Belgium | 405/151 |
| 860487 | 9/1940 | France | 405/134 |
| 825298 | 12/1959 | United Kingdom | 405/132 |
| 834675 | 5/1960 | United Kingdom | 405/149 |

OTHER PUBLICATIONS

"Engineering News", Nov. 25, 1909, p. 581.

*Primary Examiner*—Dennis L. Taylor
*Assistant Examiner*—John Ricci
*Attorney, Agent, or Firm*—Bean, Kauffman & Spencer

[57] ABSTRACT

The disclosed invention comprises novel prefabricated tunnel sections comprising generally open channel configured, reinforced concrete, opposing lower and upper channel members with mating elements along opposing leg edges of the channel for forming a generally rectangular, tubular, assembled tunnel section having opposite ends with rectangular edges grooved for interlocking engagement with a generally matching, grooved adjacent assembled tunnel sections and containing metal tying plates for holding the sections together in an assembled tunnel. A system is also disclosed for on site assembly of a vehicular tunnel comprising the sections.

20 Claims, 4 Drawing Sheets

Fig. 3.
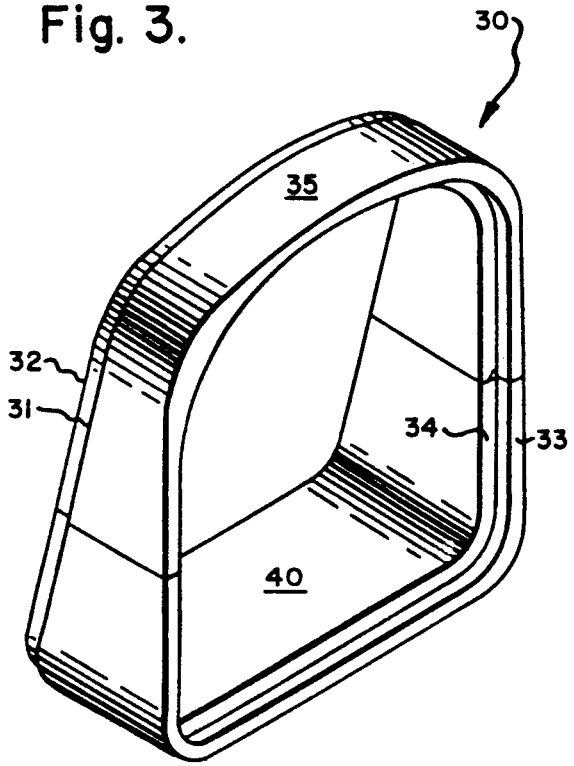
Fig. 2.
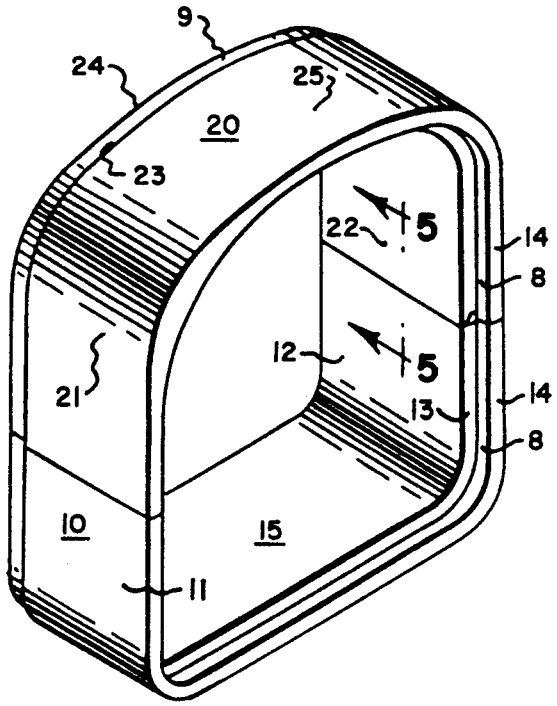
Fig. 4.
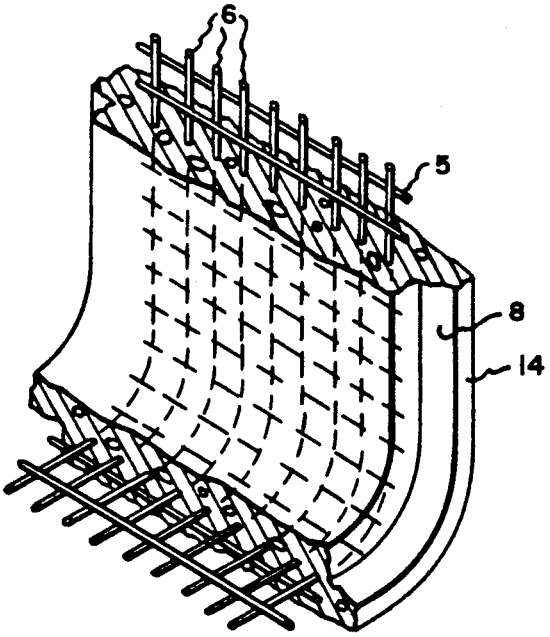
Fig. 5.
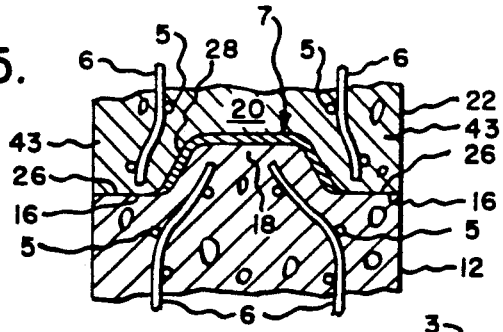
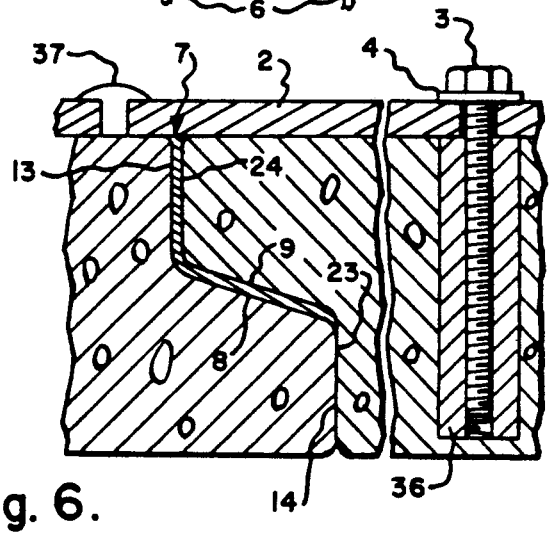
Fig. 6.

Fig. 9.
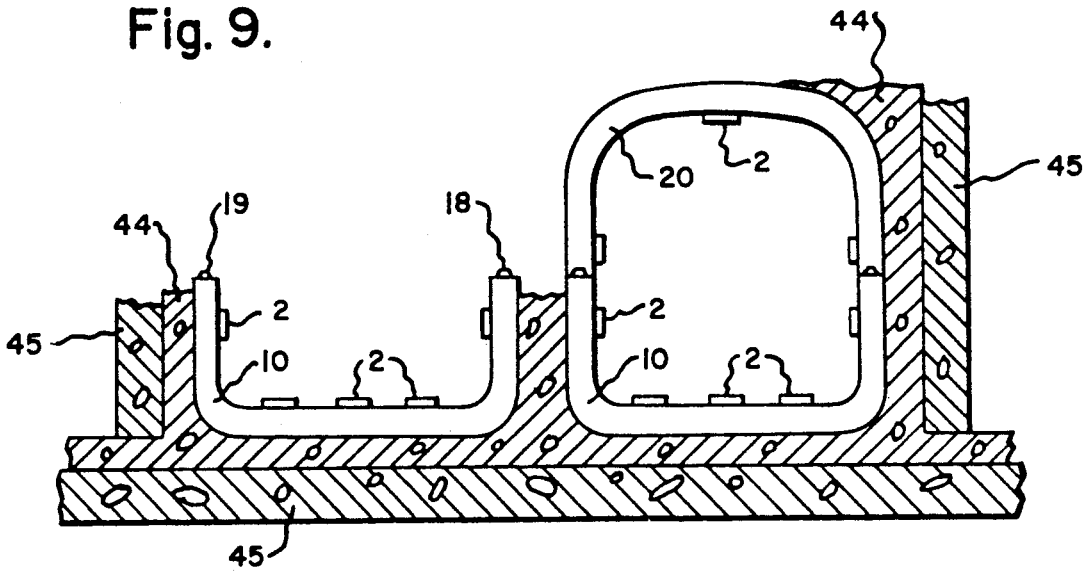
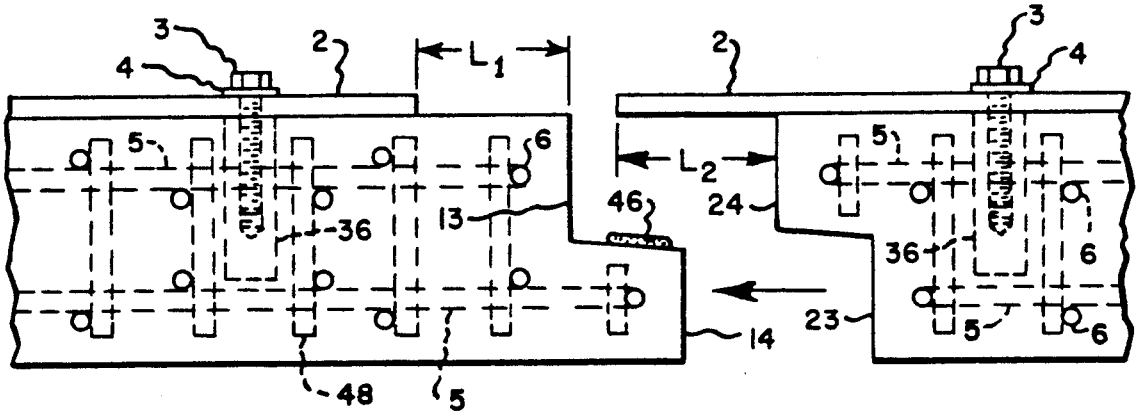
Fig. 10.
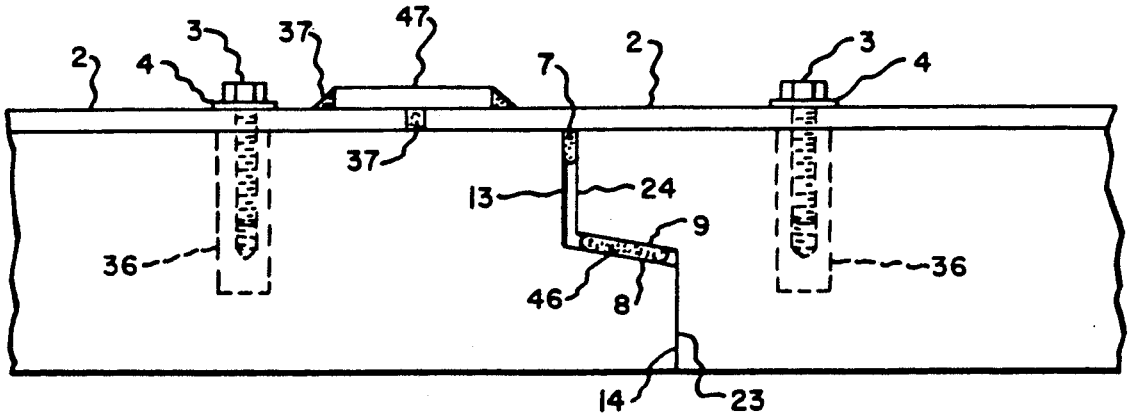
Fig. 11.

SEGMENTED TUNNEL SYSTEM

This application is a continuation-in-part of U.S. application Ser. No. 07/406,619 filed Sept. 13, 1989, now abandoned.

BACKGROUND OF THE INVENTION

This invention generally relates to new and improved tunnel construction systems and components thereof, having particular adaptability for off-site component manufacturing and convenient on-site assembly of vehicular passageways to avoid physical barriers.

The construction of tunnels has generally focused on the tedious fabrication of reinforced structures within bored rock, earth and the like passageways. Typically in bored tunneling, the strength of the finished tunnel comes from the dense material through which the tunnel is bored and interior panels, decorative walls and the like add marginal strength to the structure, being primarily used for aesthetic and water control purposes. As a result, prior art tunneling systems have generally concerned themselves with problems associated with working in confined passageways, particularly the problems associated with limitations to size of machinery which can be utilized to fabricate and/or assemble a reinforced structure within the tunnel. Because of such concern there has typically been opposition to the use of large prefabricated sections with the attendant difficulties of handling and/or assembling such sections in the confines of a bored tunnel. Thus, the emphasis in the prior art relating to the use of prefabricated components for tunnel construction has been to the erection and assembly of a multiplicity of modest sized panels, that may be conveniently handled by a few workers, to fabricate a constructed tunnel. The assembling of multiple modest sized panels, however, has its disadvantages in that large numbers of joints must be sealed which significantly increases the risk of leak failure as well as the cost of construction labor in the project. In many applications, the cost of prefabricated panels, the cost of assembly and the increased cost and quantity of failure prone sealed joints cannot be justified so prefabrication is avoided and a typical concrete tunnel is poured, sprayed, troweled or otherwise formed in place.

It is an object of the instant invention to provide an improved system for assembling vehicular tunnels. It is also an object to provide an improved system comprising the use of prefabricated components. It is a further object to provide an improved system for fabricating tunnels comprising prefabricated components which require fewer seals during installation. It is a still further object of the invention to provide new prefabricated components for use in fabricating vehicular tunnels. These and other objects will become apparent from the following disclosure of the invention.

SUMMARY OF THE INVENTION

The present invention discloses novel prefabricated tunnel sections and a system for the on site assembly of a vehicular tunnel comprising said sections.

Prefabricated tunnel sections of the invention, comprise opposing lower and upper generally open channel configured members, formed from reinforced concrete and having generally mating tongued and grooved elements along opposing leg ends which interlocking engage the upper member to the lower member to form a generally rectangular, tubular, assembled tunnel section, said section having one or more rectangular ends configured with a beveled lap for interlocking engagement with a generally oppositely matching beveled lap end of another assembled tunnel section. An assembled tunnel section has fixedly engaged to interior walls thereof and extending outwardly from an end of said section, metal attachment plates for tying and alignment engagement with an adjacent another section and means for fixedly engaging metal attachment plates extending outwardly from an adjacent another section to said assembled tunnel section.

The new system for assembling the prefabricated components comprises preparing an open trench; lining the bottom surface of said open trench with stones; installing in the lined trench, in interlocking engagement with generally matching opposed beveled lap ends, prefabricated, reinforced concrete, lower members of the invention, with channel legs comprising tongued mating elements extending upwardly; installing, in interlocking engagement, prefabricated, reinforced concrete, upper members of the invention, with channel legs comprising grooved mating elements, extending downwardly on said lower unit to form a plurality of interlocking, generally rectangular sections; fixedly engaging metal attachment plates extending outwardly from interlocking sections to adjacent sections; lining an area between sides of said trench and the assembled sections with stones; and, back filling areas of the trench to the desired grade level.

Reinforcement of the concrete upper and lower channel members can be typically by any convenient means known in the prior art. Generally it is preferred that such reinforcement comprise two spaced apart layers of reinforcing bar, with each layer comprising crossing bars in a net like configuration. An especially preferred reinforcement arrangement comprises two layers of about three fourths inch diameter reinforcement rod, spaced apart about 6 inches, with each layer arranged in a net like configuration to define about 8 inch squares.

The metal attachment plates are anchored to the upper and lower members after the pre-casting process, generally with the pre-cast upper and lower members including holes for subsequent insertion of bolts, preferably cadmium plated bolts, or compression fittings and the like. Typically it is preferred to use cast-in-place threaded fittings or the like in the pre-casting process for attachment of the metal plates thereto. Generally it is preferred that each member comprise at least one section to section attachment plate on each leg, two or more section to section attachment plates on the connecting channel base of the lower member and one section to section attachment plate on the connecting channel base of the upper member. The section to section attachment plates serve at least two functions in that they act to tie sections together by fixedly engaging adjacent sections and provide aligning means during assembly. Additionally, upper member to lower member leg attachment plates can be arranged to extend from a leg of the upper member to the leg of a lower member to assist in aligning the upper and lower members during assembly and provide added fixing engagement at the joinder of the upper and lower members when fixed to adjacent legs of a corresponding member by bolt means and the like.

Generally, the weight of the upper unit, particularly the weight of multiple interlocking upper units in an assembled tunnel, is adequate to securely join the upper and lower members in assembly. Typically, upon assembly of the upper and lower members into a tunnel section, metal rods, channels, tubing, plates or the like are attached between section to section attachment plates of opposing legs of mated upper and lower members to form a mounting base for attachment of utility services, guard rails or the like, while also acting to further secure the joint between the upper and lower members. Alternately, longitudinally extending guard rails or the like may be directly mounted to section to section attachment plates of opposing legs of mated upper and lower members.

Generally it is preferred that the outward extending end of attachment plates of one section abut a non-outward extending end of a corresponding attachment plate of an adjacent section so that they may be butt welded, end to end, within the adjacent section for tying the sections together. Further metals may be welded over the butt welded plates for additional strength. Generally it is desirable to forcibly hold the sections together, under pressure, during the butt welding process to assure a leak resistant fit.

In the manufacture of the upper and lower members it is generally preferred to have the male element of the tongue and groove in the member to member mating end of the upwardly extending legs of the lower member and the female element in the member to member mating end of the downwardly extending legs of the upper member for improved sealing. Generally it has been found preferable to size the female element slightly larger than the male element and apply caulking material to the members prior to assembly.

The section to section mating ends of the upper and lower members are also matched to allow ready engagement of the beveled ends to form lap joints between generally rectangular sections. Generally it has been found preferable to size the bevel of the ends so that a strip of sealing and/or caulking material can be installed between the beveled surfaces and will be compressed as one section is drawn toward the other during assembly.

Generally, an elastomeric caulking compound or the like is applied to the tongue and groove elements and the interlocking lap joint surface edge arrangement prior to assembly to assure a leak resistant fitting. One particularly effective caulking means comprises thin strips of caulking material which are placed on the beveled surface of the interlocking ends of sections. As the beveled surfaces of the interlocking ends are moved toward each other in locking engagement during assembly, the caulking strip will become compressed and angularly stressed causing it to be spread about the beveled interlocking surfaces, thus providing an appropriately sealed joint. It should be understood that it is also contemplated as within the invention to include adhesive materials at these seams and to use other caulking materials such as treated rope material and the like to be applied before and/or after assembly of the units.

Generally it is preferred that the upper and lower members be pre-stressed in construction for anticipation of the weight that it might bear in its proposed utility. It is also anticipated that the pre-cast upper and lower units contain appropriate openings and the like for installation of appropriate electrical, heating, gas, telephone, ventilation and the like services.

Typically section to section mating ends of an upper or lower member will be generally parallel and are generally perpendicular to the channel base of the upper or lower member. However, where the tunnel being constructed requires changes in grading and/or direction, it is anticipated that such section to section mating ends will diverge from parallel and/or perpendicular to allow grade and/or direction changes. Thus, an assembled section comprising an upper and lower member may have one or more ends defining the assembled rectangular section which are not perpendicular to the base of a channel and/or are not parallel with a corresponding end and/or are not equidistant from opposite ends. It should be understood that the aforesaid is not only true of the ends comprising the legs of the members, but also is inclusive of the ends of the channel base of an upper or lower member. Generally it is preferred that divergence of leg edges be no greater than about 15 degrees from perpendicular to the channel base of an upper or lower member with 2 and one half through 10 degree variations being preferred for most grade changes. It should be understood as contemplated within the invention that as section to section ends diverge from parallel, ends of attachment plates may be angled to provide adequate welding surface.

Generally, the system of the invention anticipates that the assembled tunnel may or may not be the primary support for loads above the tunnel. For example, though the assembled tunnel is anticipated to support back fill and the like to ground level, additional support means is contemplated for support of particularly heavy loads such as train tracks, particularly the heavy loads which might be transported thereover. In such instance it is contemplated that a structural support or the like be incorporated into the trench adjacent the assembled tunnel to provide added support to the tracks or the like.

BRIEF DESCRIPTION OF THE DRAWINGS

The nature and mode of operation of the present invention will now be more fully described in the following detailed description taken with the accompanying drawings wherein:

FIG. 2 is a perspective view of an assembled section comprising an upper and lower member of the invention;

FIG. 3 is a perspective view of an assembled section wherein leg edges are not parallel to the channel base of the upper and lower members;

FIG. 4 is an enlarged fragmentary view of FIG. 3 showing reinforcing rods of the members;

FIG. 5 is an enlarged fragmentary section taken along about line 5—5 of FIG. 2;

FIG. 6 is an enlarged fragmentary longitudinal sectional view taken in the area designated FIG. 6 in FIG. 7;

FIG. 9 is a sectional view of a lower member and a section installed side by side at a typical tunnel site; and, FIGS. 10 and 11 are enlarged fragmentary longitudinal sectional views showing the sequence of assembly of interlocking front and rear edges of a tunnel section of the invention.

DETAILED DESCRIPTION

It will be understood at the outset that the tunnel sections and system of the present invention possesses utility in assembling diverse tunnels. However, in order to facilitate description of the present invention, specific reference will be made to the drawings as follows.

Figure 1:
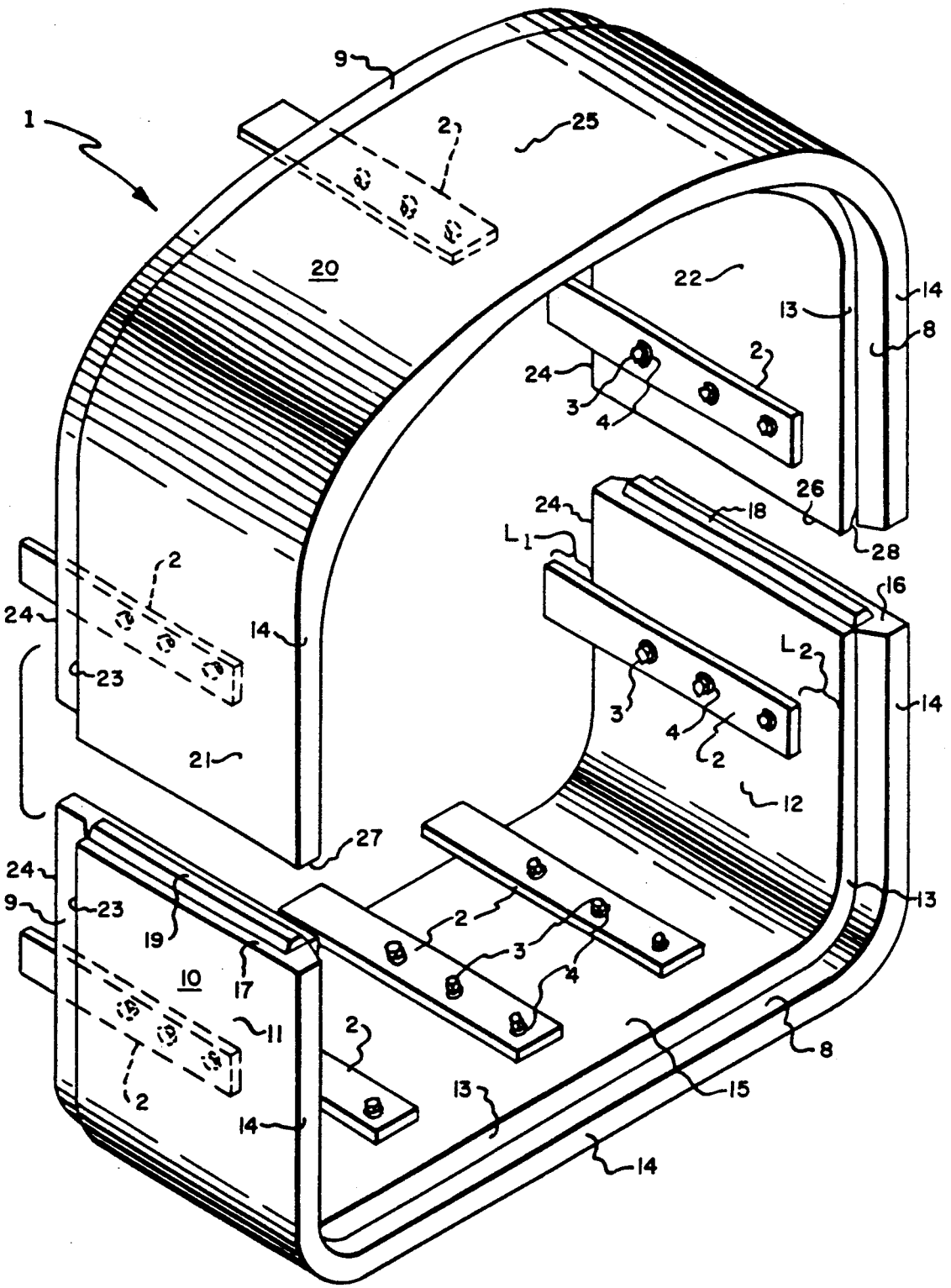
FIG. 1 is an exploded perspective view of a tunnel section of the present invention comprising a lower and upper member.

FIG. 1 illustrates a configuration of tunnel section 1 wherein lower member 10 and upper member 20 are in exploded juxtaposition from their assembled state and comprising attachment plates. FIG. 2 shows tunnel section 1 in its assembled state, without attachment plates. In these figures, lower member 10 comprises upwardly extending first leg 11 and second leg 12 interconnected through lower channel base 15. Front interior edge 13 and front exterior edge 14 are illustrated as generally parallel to rear exterior edge 24 and rear interior edge 23, respectively. Extending between the front and rear exterior and interior edges are beveled lap surfaces 8 and 9 respectively. Upwardly extending joint edge 16 of leg 12 comprises outward tongue extension 18 and upwardly extending joint edge 17 of leg 11 comprises outward tongue extension 19. Upper member 20 comprises downwardly extending first leg 21 and second leg 22, interconnected through upper channel base 25. Front interior edge 13 and front exterior edge 14 are generally parallel to rear exterior edge 24 and rear interior edge 23, respectively and have extending between them beveled lap surfaces 8 and 9 respectively. Downwardly extending joint edge 26 of leg 22 comprises tongue groove 28 and downwardly extending joint edge 27 of leg 21 comprises tongue groove 29 (shown in FIG. 8), both of which are configured to generally mate with outward tongue extensions 18 and 19.

In FIG. 1, section to section attachment plates 2 are mounted to upper member 20 and lower member 10 by means of bolts 3, secured by lock washers 4. In the illustrated tunnel section 1, lower channel base 15 of lower member 10 comprises three attachment plates, while upper channel base 25 of upper member 20 comprises one attachment plate. Each side leg 11, 12, 21 and 22 comprise one attachment plate. The length of an attachment plate "L1" extending beyond rear exterior edge 24 of tunnel section 1 should be equal or less than the distance "L2" from the front interior edge 13, of tunnel section 1, to the mounted attachment plate. Generally it is preferred that the distance be at least one fourth inch or more less. FIG. 3 illustrates tunnel section 30 comprising upper member 35 and lower member 40 having front interior edge 31 and front exterior edge 32 diverging vertically from rear exterior edge 33 and rear interior edge 34, respectively. Divergence allows convenient modification of the slope of a tunnel comprising multiple tunnel sections, upwardly or downwardly. It should be understood that it is also contemplated as within the invention for front edges to diverge horizontally, or any angle between horizontal and vertical, from the rear edges so as to allow convenient modification of sideways direction of multiple tunnel sections, including compound direction changes wherein both slope and sideways direction occur.

FIG. 4 comprises an enlarged fragmentary section of a lower member illustrating a single layer arrangement of reinforcing rods comprised within a lower member of concrete construction. Therein, laterally arranged reinforcement rods 5 cross longitudinally arranged reinforcing rods 6 to form about 8 inch squares. Typically, the rods are joined at their point of crossing 7. A preferred arrangement of reinforcing rods comprises two layers by spacer bars 48 of crossing rods distanced about 6 inches therebetween layers.

FIG. 5 comprises an enlarged fragmentary view of a tongue and groove joint of the joined legs of an upper and lower member of the invention. Therein, joint edge 26 of downwardly extending leg 22 of upper member 20 rests on joint edge 16 of upwardly extending leg 12 of lower member 10. Outward tongue extension 18 generally mates with tongue groove 28 to form a locking arrangement of the upper member with the lower member comprising the tunnel section. The arrangement of reinforcing rods 5 and 6 is shown in its preferred form as comprising two layers of reinforcing rod, in net like arrangement, terminating at the outer lips 43 formed by tongue groove 28 and diverging to outward tongue extension 18. Caulking compound 7 is comprised therebetween acting to seal the joint between the upper and lower member.

FIG. 6 comprises an enlarged fragmentary view of the interlocking front and rear edges of tunnel sections of the invention. Therein, a front portion of first concrete tunnel section, having front interior edge 13, front exterior edge 14 and front beveled lap surface 8, is illustrated interlocking with a rear portion of a second concrete tunnel section having rear interior edge 23, rear exterior edge 24 and rear beveled lap surface 9. Caulking compound 7 is comprised between the interlocking edges and beveled lap surfaces to seal the joint between the tunnel sections. Plate 2 is mounted to the second tunnel section by means of bolt 3 and lock washer 4. Bolt 3 is affixed to the second tunnel section through cast-in-place threaded fitting 36. Plate 2 is butt welded 37 to a corresponding plate affixed to the first tunnel.

Figure 7:
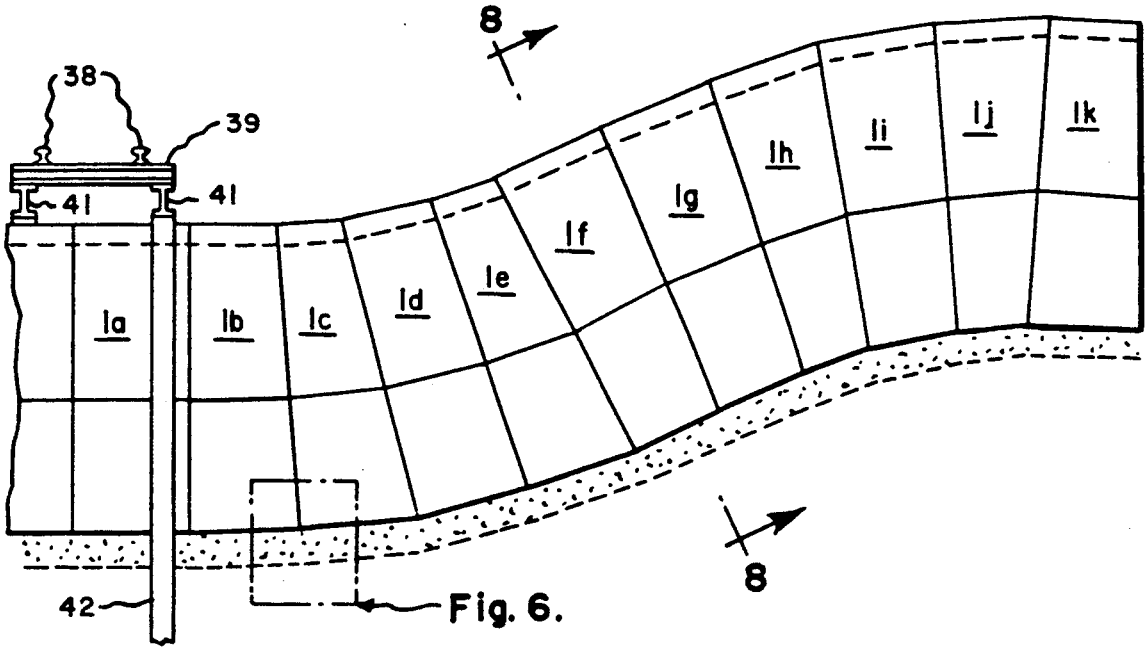
FIG. 7 is a side plan view of an arrangement of upper and lower members forming a tunnel in a trench with added supporting structure for carrying railroad tracks.

FIG. 7 illustrates a proposed tunnel comprising multiple tunnel sections 1*a*–1*k* arranged in series under railroad tracks 38. Tunnel section 1*a* comprises front and rear edges which are generally parallel, while the edges of each of tunnel sections 1*b*–1*k* are diverging relative to each other. Tracks 38 are supported by beams 39, which in turn are supported by "I" beams 41. Vertical beams 42 are arranged adjacent the side of the tunnel to provide support to "I" beams 41 and are generally supported by concrete base structures. The tunnel structure is supported on a gravel base to provide drainage and support.

Figure 8:
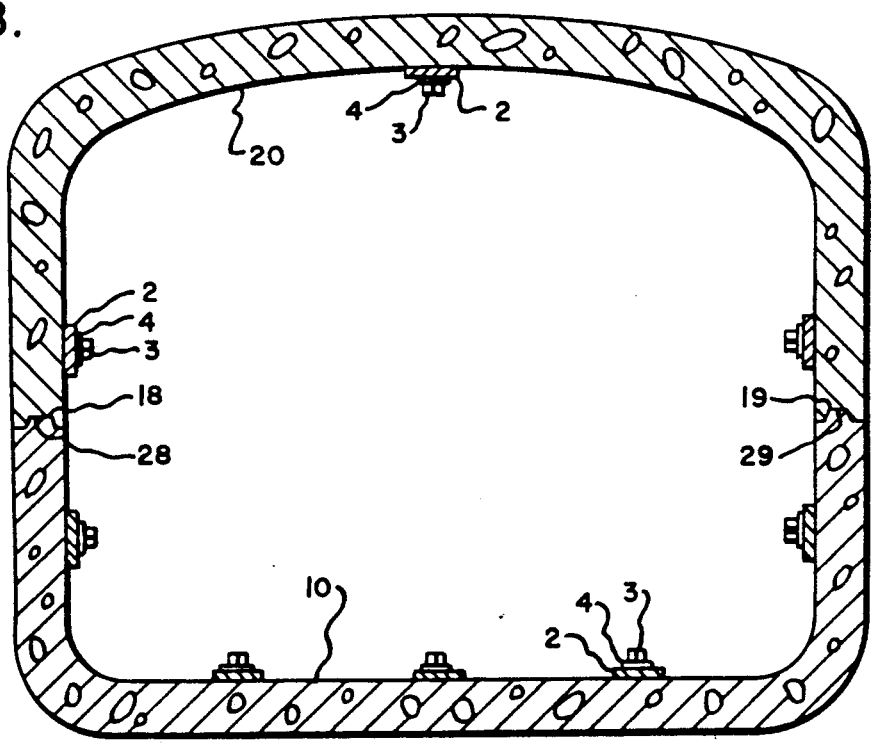
FIG. 8 is a sectional view taken along about line 8—8 of FIG. 7.

FIG. 8 is a cross section of tunnel section 1*f* of the tunnel of FIG. 7, showing the relative positioning of the attachment plates tying the tunnel sections together.

FIGS. 10 and illustrate a typical sequential mating sequence of lower or upper members of tunnel sections. FIG. 10 depicts the juxtaposition ends of mating of upper or lower members of adjacent tunnel sections as they would be positioned in the mating process. Also shown is an alternate configuration for the arrangement of reinforcement rods in the cast members, showing two rows of internal ribbing. FIG. 11 depicts the adjacent members of the tunnel sections in mated position showing the compression and spreading of elastomeric sealing strip 46. In this embodiment, reinforcement plate 47 has been welded over the butt weld joint between attachment plates and a gap, preferably about one fourth inch, has been intentionally left in the inner portion of the mated sections for insertion of liquid sealing composition and vacuum impregnated, nylon caulking rope.

FIG. 9 is a sectional view of two lower members installed in place at a typical tunnel site with a top member in place on the right side only. Also shown is a preferred arrangement of bedding materials about their installation. Therein, interior stone bedding 44 is shown as comprising at least about 18 and preferably 24 or more inches of fine gravel, laying on top of exterior stone bed 45 comprising at least about 18 and preferably 24 inches or more of coarse gravel. The two lower members would be separated by about 30 or more inches of fine gravel and the remaining fill, surrounding the beds, would comprise soil, sand, stones or mixtures thereof.

I claim:

1. A prefabricated tunnel section comprising generally open channel configured, reinforced concrete, opposing lower and upper channel members, having generally opposite matching tongue and grooved mating elements along opposing leg edges of the channel member for interlocking engagement to form a generally rectangular, tubular, assembled tunnel section having opposite ends; an end of an assembled tunnel section being beveled, to form a gap when in interlocking engagement with a generally opposing beveled end of another generally rectangular, tubular assembled tunnel section; said assembled tunnel section having fixedly engaged to interior walls thereof and extending outwardly from an end of said section, metal attachment plates; said plates arranged for engagement with an interior wall of an adjacent another section for supporting alignment with said another section; and, means for fixedly engaging metal attachment plates extending outwardly from an adjacent another section to said assembled tunnel section.

2. A prefabricated tunnel section of claim 1 comprising a caulking material between opposing leg edges of opposing lower and upper channel members.

3. A prefabricated tunnel section of claim 2 wherein said caulking comprises a strip of caulking material.

4. A prefabricated tunnel section of claim 1 reinforced by crossing metal reinforcement bars in a net like arrangement.

5. A prefabricated tunnel section of claim 4 comprising two layers of crossing metal reinforcement bars in separate, spaced apart, net like arrangement.

6. A prefabricated tunnel section of claim 4 wherein said net like arrangement defines squares comprising about 8 inch squares.

7. A prefabricated tunnel section of claim 1 wherein said means for fixedly engaging metal attachment plates comprises bolt means.

8. A prefabricated tunnel section of claim 1 comprising metal attachment plates on each leg of the upper and lower members.

9. A prefabricated tunnel section of claim 1 comprising metal attachment plates between legs of the upper and lower channel members.

10. A prefabricated tunnel section of claim 1 wherein leg edges of said lower channel member comprise an outwardly extending tongue element and edges of said upper channel member comprise a generally mating groove element.

11. A prefabricated tunnel section of claim 1 wherein said lower and upper channel members are pre-stressed.

12. A prefabricated tunnel section of claim 1 wherein an edge of one end is at an angle to a edge of the other end.

13. A prefabricated tunnel section of claim 1 wherein edges of one end are parallel to edges of the other end.

14. A tunnel comprising at least one tunnel section of claim 1.

15. A tunnel of claim 14 comprising caulking between opposing leg edges of opposing lower and upper channel members and between tunnel sections.

16. A tunnel of claim 14 comprising tunnel sections reinforced by crossing metal reinforcement bars in a net like arrangement.

17. A tunnel of claim 16 having tunnel sections comprising two layers of crossing metal reinforcement bars in separate, spaced apart, net like arrangement.

18. A process for assembling prefabricated components of claim 1 comprising, preparing an open trench; lining the bottom surface of said open trench with stones; installing in the lined trench, in interlocking engagement, said prefabricated lower channel members, with legs comprising mating elements extending upwardly; installing, in interlocking engagement, said prefabricated upper channel members, with legs comprising mating elements extending downwardly on said lower unit to form a plurality of interlocking generally rectangular sections; fixedly engaging said metal plates extending outwardly from interlocking sections to adjacent sections; lining an area between sides of said trench and the assembled sections with stones; and, back filling the trench to the desired grade level.

19. The process of claim 18 wherein caulking material is applied to a leg edge of said channel members before assembly thereof.

20. The process of claim 18 wherein caulking material is applied to an end of a channel member of a first section before assembly with a channel member of a second section.

* * * * *